US005127554A

United States Patent [19]

Loychuk

[11] Patent Number: 5,127,554

[45] Date of Patent: Jul. 7, 1992

[54] AEROSOL POWER SYSTEM

[75] Inventor: Terrence Loychuk, North Vancouver, Canada

[73] Assignee: Nozone Dispenser Systems Inc., Canada

[21] Appl. No.: 654,797

[22] Filed: Feb. 13, 1991

Related U.S. Application Data

[63] Continuation-in-part of Ser. No. 355,197, May 19, 1989, abandoned.

[51] Int. Cl.[5] ..... B67D 37/00

[52] U.S. Cl. ..... 222/183; 222/212; 222/386.5

[58] Field of Search ..... 222/95, 212, 215, 183, 222/103, 386.5, 288; 604/132; 128/DIG. 12

[56] References Cited

U.S. PATENT DOCUMENTS 3,876,115 4/1975 Venus et al. ..... 222/183
3,961,725 6/1976 Clark ..... 222/211
4,121,737 10/1978 Kain ..... 222/212
4,222,499 9/1980 Lee et al. ..... 222/215
4,446,991 5/1984 Thompson ..... 222/183

*Primary Examiner*—H. Grant Skaggs
*Attorney, Agent, or Firm*—Barrigar & Oyen

[57] ABSTRACT

A novel dual bladder-type aerosol power system which can be used in a standard aerosol spray container. The aerosol powering system utilizes a dual independent rubber-type bladder combination to generate the expulsion power for the aerosol. A power system for an aerosol spray generating nozzle comprising: (a) a nozzle adapted to generate an aerosol vapor spray; (b) an inner hollow resilient power bladder connected to the nozzle, the resilient bladder being adapted to contain the liquid used to generate the aerosol spray, and (c) an outer resilient power bladder enveloping the inner bladder, the inner and outer bladders cooperating to generate a pressure on the liquid when filled with the liquid.

7 Claims, 1 Drawing Sheet

AEROSOL POWER SYSTEM

This is a continuation-in-part of application Ser. No. 355,197, filed May 19, 1989, now abandoned.

FIELD OF THE INVENTION

This invention is directed to a novel dual resilient bladder-type aerosol power system which can be used in a standard aerosol spray container. More particularly, this invention pertains to an aerosol powering system which utilizes a dual resilient rubber-type power tube combination which cooperates to generate the expulsion power for the aerosol. This system of dual power tubes delivers more power than a single power tube of the same material type and thickness and circumvents the need to use volatile propellants which have been demonstrated to be harmful to the protective ozone layer of the earth.

BACKGROUND OF THE INVENTION

In recent years, there has been alarming evidence that the protective ozone layer of the earth is shrinking in thickness. The ozone layer is critical to the health of living organisms inhabiting the earth because the ozone layer filters out deadly ultra-violet rays, and other rays, emitted by the sun. Considerable evidence has been gathered to demonstrate that the damage that is occurring to the ozone layer is caused by a number of mankind generated free radicals and freon-type propellents which have been used in aerosol container spray systems for many years. These propellents are lighter than the atmosphere and rise to the elevation of the ozone layer. Chemical reactions then take place between the radicals and the ozone in the ozone layer thereby forming other compounds and complexes and diminishing the free ozone in the ozone layer. There has even been recent evidence to indicate that deadly holes have appeared in certain portions of the ozone layer, for example, over Antarctica. If this trend continues, then the health of mankind will be jeopardized.

Recently, industrialized nations of the world have agreed to an international moratorium on the use of substances which have been demonstrated to have a destructive effect on the ozone layer of the earth. In 1987, the United States enacted sunset-type legislation which will force companies which are manufacturing substances which are demonstrated to have a destructive effect on the ozone layer, to phase out production of such harmful substances over a specified number of years. One of the most ozone layer destructive family of substances being manufactured are chlorofluorocarbons and fluorocarbons (Freons), which are widely used as coolants in refrigeration systems, and as propellents in aerosol spray containers holding products such as hair spray, cleaning compounds, and the like.

Because of the mounting evidence that chlorofluorocarbon and fluorocarbon propellents, and similar type propellents, in aerosol contained spray systems, have an accumulative damaging effect on the ozone layer, it is critical to the long term health of living beings on the earth to develop alternative aerosol generating containers which do not rely upon ozone destroying propellents. As an alternative, many aerosol-type consumer products recently introduced on the market use a pump type aerosol spray generating system, rather than the volatile propellent contained in an aerosol container. However, such manually operated aerosol pump systems are not entirely satisfactory because they are incapable of generating a fine consistent spray similar to the type that is generated by an aerosol container employing a fluorocarbon propellent.

A number of patents have been granted in recent years for aerosol generating pump systems, and the like. These are useful as alternatives to volatile propellent aerosol generating systems. U.S. Pat. No. 3,993,069, for example, illustrates a pumping system which utilizes a natural rubber bladder which is inflated and thereby generates pumping action from the force created by the bladder in seeking to return to its original size and shape.

Clark, U.S. Pat. No. 3,961,725, discloses a bladder power system with a tube which extends down the center of the bladder, the tube serving to keep the bladder in consistent shape as the bladder is inflated. Clark does not disclose that an inner resilient tube and an outer resilient tube can act in concert to generate a cumulative pressure on the contained liquid.

Kain, U.S. Pat. No. 4,121,737, discloses a "hot water bottle" type of bladder. Such a bladder is wider in one direction than the other. Such a construction makes it difficult for the bladder to co-operate with a liner which has the same shape. Consistent pressures are not generated. Moreover, Kain at column 4, line 29, specifically states that the liner 32 can be flexible but preferably has "only limited elasticity." At column 4, line 44, Kain states that the principal purpose of the liner is to prevent contact between the product to be dispensed and the material of construction of the pressure unit.

Lee et al., U.S. Pat. No. 4,222,499, disclose an outer resilient tube 12, which generates dispensing power, and a liner 64 which is not elastic. Since liner 64 is not elastic, Lee et al. evidently were not aware of the fact that a resilient liner could be used in association with a resilient outer tube to generate cumulative power on the contained liquid. Lee et al. were not aware that the liner could serve any other purpose than a simple liner to separate the contained liquid from the outer tube.

Thompson, U.S. Pat. No. 4,446,991, discloses a bladder powered aerosol system, but the liner 62 is simply a coating. Thompson does not disclose a resilient liner which in concert with the outer tube generates cumulative dispensing pressure.

SUMMARY OF THE INVENTION

An aerosol spray generating system which utilizes a dual independent concentric resilient rubber bladder tube combination which cooperates to generate the power required to create an aerosol spray, when the liquid contents in the aerosol can are forced into a spray nozzle. The independent dual bladder system generates more power than a single bladder of equal thickness constructed of the same material.

An aerosol spray generating power system comprising: (a) a nozzle adapted to generate an aerosol vapour spray; (b) a first hollow resilient open-ended closed bottom power tube connected to the nozzle, the resilient power tube being adapted to contain liquid used to create the aerosol spray, the resilient power tube generating a pressure on the liquid when the resilient power tube is expanded with the liquid; and, (c) a second hollow resilient open-ended closed bottom power tube located on the exterior of the first resilient power tube, the first resilient power tube and the second resilient power tube being independent of one another in movement but co-operating together when expanded with the liquid in the first hollow power tube to provide a cumulative pressure on the liquid to thereby dispense the liquid through the nozzle.

The resilient means may be formed of natural rubber. The first tube may be formed of a material selected from the group of materials consisting of food grade silicone rubber, natural latex, and Neoprene. In the apparatus as defined, the second resilient means can be capable of expanding at least about 600%. The first tube can be capable of expanding at least about 800%. The resilient means can be constructed to have a collar around the open end. The apparatus can include a connector means which connects the collars of the first resilient tube and the second resilient tube means with the nozzle means. In the system as defined, the first resilient tube and the second resilient tube can be housed in a container, and the nozzle means can be located at the top of the container and attached to the container and the concentric pair of resilient tubes.

DRAWINGS

In the drawings, which represent specific embodiments of the invention, but which should not be regarded as restricting the spirit or scope of the invention in any way:

DETAILED DESCRIPTION OF SPECIFIC EMBODIMENTS OF THE INVENTION

Figure 1:
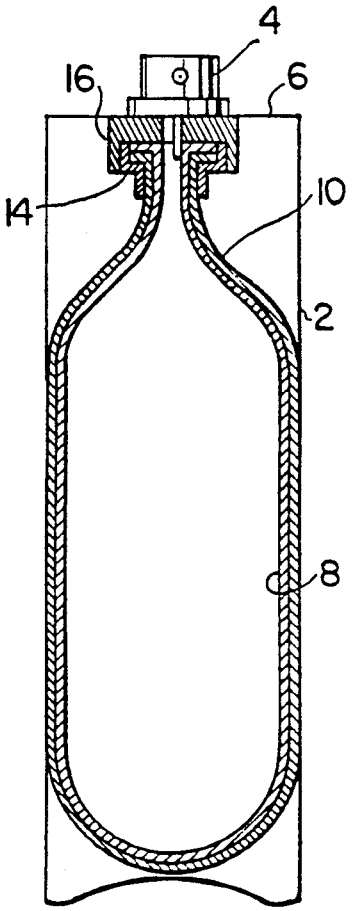
FIG. 1 illustrates a side elevation partial section view of a liner-power tube combination in inflated condition inside an aerosol can.

Referring to the drawings, FIG. 1 illustrates a side elevation partial section view of the components that make up the dual bladder powered aerosol can 2. As seen in FIG. 1, a conventional aerosol can 2 has at the top thereof a stamped metal can top 6. Inserted into the interior of the can 2 through can top 6, is a resilient rubber power outer tube 10, which embraces an inner resilient power tube 8. A conventional aerosol spray nozzlecap 4 is positioned above the inner power tube 8 and the outer power tube 10. A connector 16 and a collar 14 combination is used to enable the various components to be assembled together.

Figure 4:
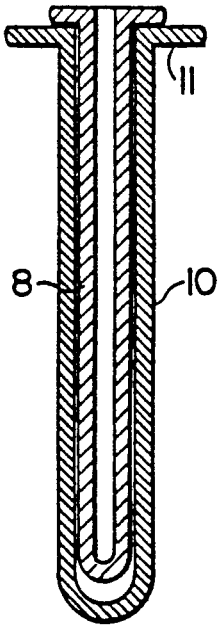
FIG. 4 illustrates a side elevation view of a liner tube inserted into a power tube.

FIG. 1 also illustrates in side partial-section view the manner in which the inner power tube 8 and the outer power tube 10 inflate together within the interior of aerosol can 2, when the inner power tube 8 is pumped full of an appropriate aerosol dispensed consumer product. As seen in FIG. 1, which can be interpreted somewhat as a stylized representation in order to illustrate the function of the invention, the inner tube 8 and the outer tube 10 expand independently so that the outside of inner power tube 8 remains juxtapositioned against the inside of the outer power tube 10. It is important that the inner power tube 8 and the outer power tube 10 are not glued or affixed together. They must expand independently in order to achieve the full benefits of the two concentric power tubes. As seen in FIG. 4, the outer power tube 10 is substantially longer than inner power tube 8, when not expanded. However, the difference in length is reduced with simultaneous expansion, as seen in FIG. 1.

When the spray top 4 is manually activated, the combined energy stored in the expanded inner power tube 8 and expanded outer power tube 10 forces a small portion of the contents of inner power tube 8 out to the nozzle of the spray top 4. The size of the outer power tube 10 and the liner power tube 8 gradually decrease independently as the contents of the liner tubes are gradually expelled through repeated activations of nozzle 4.

It has been discovered unexpectedly that the energy stored in expanded power tubes 8 and 10 respectively combine together in a summation manner to generate cumulative power to expel the liquid contents from the inner tube 8. Normally, it would have been expected that the power generated by such a system would be dependent solely upon the stronger of the two tubes, and the weaker tube would be carried by the stronger tube.

It has also been discovered that the total power generated by a given thickness of an inner and an outer power combination tube is greater than a single power tube of the same thickness and material. To achieve this cumulative effect, it has been found that it is critical that the two tubes 8 and 10 can expand separately and independently of one another. The two tubes must not be glued or affixed together. If they are, then the cumulative superior expulsion force is not achieved.

Figure 2:
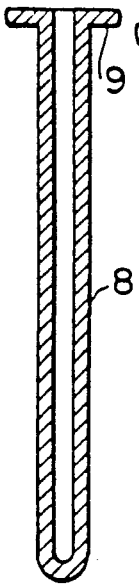
FIG. 2 illustrates a side elevation view of a liner tube.

FIG. 2 illustrates a side elevation view of the inner power tube 8. This inner power tube 8 can act as a liner and may be constructed of a number of suitable liquid impermeable resilient materials, depending upon the nature of the contents that are to be packaged in the interior of the inner power tube 8. The inner power tube 8 has a flange 9 around the top thereof, to permit a snug fit with the interior of collar 14 and connector 16, and to prevent the tube 8 squirming free when expanded. If food items are to be contained in the inner tube, then a conventional food grade quality silicone rubber can be used for constructing the inner power tube 8. For non-food contents, the inner power tube 8 can be manufactured of natural latex, or a synthetic rubber such as Neoprene, manufactured by Thiokol.

Figure 3:
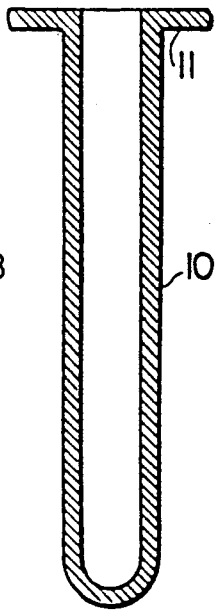
FIG. 3 illustrates a side elevation view of a power tube.

FIG. 3 illustrates a side elevation view of the outer power tube 10, with top flange 11. Flange 11 cooperates snugly with flange 9 of inner power tube 8, and prevents the outer power tube 10 from squirming loose when the tubes 8 and 10 are inflated. The combined action of the outer power tube 10 and the inner power tube 8 is critical to the successful operation and performance of the aerosol generating power system. The outer power tube 10 is preferably constructed of a natural formulated rubber obtained from Malaysia. The natural rubber from which the outer power tube 10 is formed should be capable of expanding at least 600%. Proportionately, the inner power tube 8 should be constructed of a resilient material (such as natural rubber) which can expand in the order of 800 to 1,000%. The two tubes 8 and 10 must be able to expand independently so that cumulative power is generated when deflation of the two power tubes occurs.

The differences in expansion capacity are necessary to permit the exterior of the inner power tube 8 to remain abutted (without adhesive agent) against the interior of the outer power tube 10 when inflation or deflation occurs. In other words, the inner power tube 8 must be able to independently expand proportionately greater than the outer power tube 10, in order that the two tubes can remain closely juxtapositioned and at all times generate dual cumulative power when the outer power tube 10 and the inner power tube 8 are inflated with the contents that are to be held in the inner tube 8 of the aerosol container.

FIG. 4 illustrates in side elevation view the manner in which the inner power tube 8 is positioned in the interior of the outer power tube 10. The orientation illustrated in FIG. 4 is in the "at-rest" position. It is evident that at rest, the outer power tube 10 is substantially longer in length than the inner power tube 8.

Figure 5:
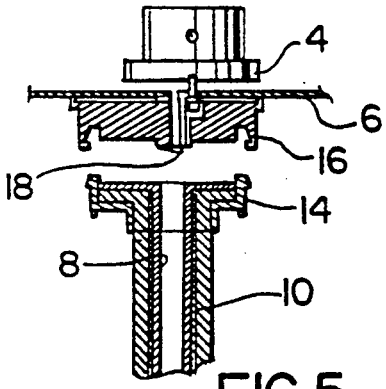
FIG. 5 illustrates a side elevation partial section view of a liner-power tube-aerosol valve arrangement.

FIG. 5 illustrates in side elevation partialsection view a valve connecting arrangement that can be utilized for the inner power tube 8-outer power 10 combination. The inner power tube 8 and outer power tube 10 are held in place by a collar 14. This collar 14 can be molded of a suitable polymer material. The inner power tube 8-power outer tube 10-collar 14 combination is fitted into a connector 16, which is secured to the underside of the can top 6 of the aerosol container. Connector 16 has a fillhole formed therein, which can be utilized for top-filling the inner power tube 8 with the product that is to be packaged in the aerosol container. A one-way valve is secured to the bottom part of the fill-hole 18 to prevent the contents of the aerosol container from exiting through the fill-hole 18 once the aerosol container has been filled.

Figure 6:
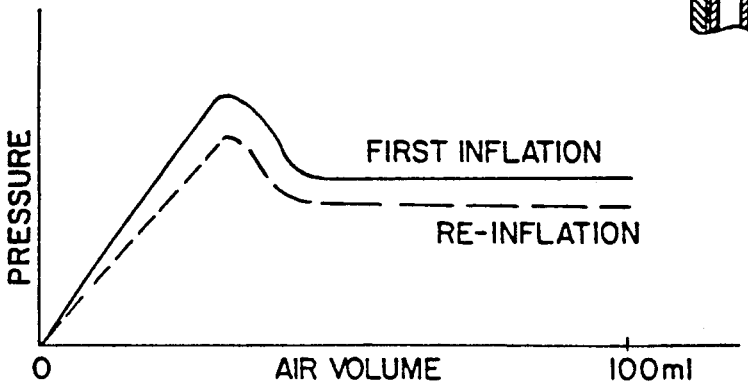
FIG. 6 illustrates a graph of pressure against air volume behaviour for an inflated and re-inflated power tube.

FIG. 6 illustrates a graphical depiction of the relationship between pressure and air volume as the dual bladder-like system (inner power tube 8, power tube 10) is inflated with air. The solid line depicts the pressure behaviour of the power tube 8-power tube 10 combination upon first inflation up to 100 millimeters of air. The dotted line depicts the pressure behaviour of the power tube 8-power tube 10 upon re-inflation up to 100 millimeters of air after the power tube 8-tube 10 combination has been deflated following the first inflation. As can be seen in FIG. 6, the pressure rises in a linear manner until a threshold "set" peak is reached. At that point, the pressure drops to a certain extent while the dual power tubes are being inflated with additional air. Once the threshold peak has been passed, and a consistent pressure has been reached, a generally horizontal relationship between air volume and pressure is realized, up to the full inflation volume of 100 millimeters of air. Interestingly, upon re-inflation, the same relationship is noted except that the pressure-air volume gradient follows a lower path. However, the curve appears to stabilize and the same pressures are achieved with repeated inflations.

An important advantage of the dual bladder aerosol powering system according to the invention is that it can be used in any position. It is not necessary to hold the aerosol can upright. Moreover, it operates efficiently at pressures lower than those typically used for propellent powered aerosol container system. Thus, with an aerosol power system according to the invention, it is not necessary to mark the containers as explosive or inflammable. Another important advantage of the aerosol power system of the invention is that no solvent dilution of the consumer product that is contained in the inner liner takes place because there is no propellant or solvent.

In filling a dual bladder combination where the inner bladder has an outer diameter which is the same as the inner diameter of the outer bladder, a high set threshhold must be overcome because both bladders commence to inflate simultaneously. This set overcoming pressure can be over 100 psi. The high set pressure means that the filling process must be slowed until the set threshhold pressure is overcome. Faster filling times can be achieved by staggering the set pressure of the inner bladder and the set pressure of the outer bladder. This can be done by having the outer diameter of the inner bladder exceed the inner diameter of the outer bladder. The inner bladder is then inserted into the outer bladder in a folded manner. When the inner bladder is filled, the set pressure of the outer bladder must be overcome before the inner bladder can inflate to the point where the set pressure of the inner bladder is reached. Alternatively, the outer diameter of the inner bladder can be less than the inner diameter of the outer bladder in order to achieve staggered set threshhold pressures.

EXAMPLE 1

Prototypes of the invention have been constructed utilizing a natural rubber outer power tube 10 formulated in Malaysia, and an inner power tube 8 formed of natural Malaysian latex. Normally, aerosol containers are pressurized to about 60 psi in order to obtain the desired aerosol spray effect. This typical high pressure can be somewhat dangerous, particularly if the aerosol can is heated, e.g. thrown into a fire. In distinction, it has been discovered that with the prototype it is only necessary to pressurize the contents of the inner power tube 8, and outer power tube 10 to about 22 psi. Moreover, it has been found that the pressure-size gradient for the dual power tube combination, as it is inflated and then deflated, once it passes a threshold peak, is nearly horizontal. There is a rise in pressure as the dual power tubes 8 and 10 are initially inflated or returned to their original uninflated condition. The virtually horizontal pressure gradient, throughout most of the inflation-deflation cycle of the inner power tube 8-outer power tube 10 combination is advantageous because it provides consistent pressure and enables a consistent fine aerosol spray to be obtained from the time the inner power tube 8 and the outer power tube 10 are fully inflated with the consumer product and then subsequently deflated in stages, by actuating the aerosol cap 4, until the point is reached where the contents of the liner power tube 8 are almost fully evacuated.

More importantly, it has been discovered that a dual separate power tube combination of a given thickness generates more power that a single power tube of the same thickness and constructed of the same material.

EXAMPLE 2

For demonstration purposes, and to evaluate the viability of the power system, an inner power tube-outer power tube combination was repeatedly inflated with 100 millimeters of air. (See FIG. 6 for an example.) Various combinations of new outer power tubes and new inner power tubes, together with used outer power tubes and used inner tubes were tested. The objective of these tests was to determine and record the different elongation and performance properties that were achieved from the various brands of latex rubber that were used to produce the outer power tubes and the liner power tubes. It was observed that after the third of fourth inflation, there was essentially no significant change in the pressure-volume relationship from further repeated inflations and deflations. To provide consistency in the test results, all inflations were maintained for thirty minutes with fifteen minute intervals between inflations. The results of these tests are summarized on Table 1 below. The heading "Laminated" means outer power tube and inner power tube in combination. "Set" means the threshold state of the dual power tubes before expanding under increased pressure.

The data in Table 1 clearly demonstrate that the pressure generated by the combination (laminated) of the inner power tube and the outer power tube is cumulative. The pressure generated is not, as would be expected, dependent solely on the stronger of the inner power tube or the outer power tube. This was an unexpected development. Normally, it would be anticipated that the total pressure generated would result from the strongest bladder and the weaker bladder would not participate, and certainly would not have a cumulative effect, that is, make the total pressure generated greater than the stronger of the two tubes. It would be expected that the weaker tube would simply be moved by the stronger tube without generating additional power.

TABLE 1

| | PRESSURE REQUIRED TO OVER-COME "SET" | (DELIVERY) "STATIC" PRESSURE | CAPACITY |
|---|---|---|---|
| Tubing #1 First Inflation | Standard Outer (Dark Orange Inner Liner) | | |
| Outer Tube #1 | 37 psi | 26 psi | 100 ml |
| Inner Tube #1 | 20 psi | 10 psi | |
| Laminated #1 | 57 psi | 36 psi | |
| Tubing #1 Second Inflation A | | | |
| Outer Tube 1A | 35 psi | 25 psi | 100 ml |
| Inner Tube 1A | 18 psi | 9 psi | |
| Laminated 1A | 53 psi | 34 psi | |
| Tubing #2 First Inflation | Standard Outer (Light Orange Inner Liner) | | |
| Outer Tube #2 | 37 psi | 26 psi | 100 ml |
| Inner Tube #2 | 23 psi | 12 psi | |
| Laminated #2 | 60 psi | 38 psi | |
| Tubing #2 Second Inflation A | | | |
| Outer Tube 2A | 35 psi | 24 psi | 100 ml |
| Inner Tube 2A | 21 psi | 11 psi | |
| Laminated 2A | 56 psi | 35 psi | |
| Tubing #3 First Inflation | Standard Outer (Red Inner Liner) | | |
| Outer Tube #3 | 37 psi | 26 psi | 100 ml |
| Inner Tube #3 | 26 psi | 14 psi | |
| Laminated #3 | 63 psi | 40 psi | |
| Tubing #3 Second Inflation A | | | |
| Outer Tube 3A | 35 psi | 25 psi | 100 ml |
| Inner Tube 3A | 24 psi | 13 psi | |
| Laminated 3A | 59 psi | 38 psi | |

Note:
1. It was observed that the third and fourth inflations brought no significant change to the results obtained from inflation #2 for all samples.
2. All inflations were maintained for 30 minutes with a 15 minute interval between inflations 1 and 2.

EXAMPLE 3

An experiment was conducted using:

(1) a ¼ inch inner diameter (ID) 3 inch length surgical tubing closed at one end, with a wall thickness of ⅛ inch;

(2) a ¼ inch inner diameter (ID) 3 inch length surgical tubing closed at one end, with a wall thickness of 1/16 inch;

(3) a ⅛ inch inner diameter (ID) 3 inch length surgical tubing closed at one end, with a wall thickness of 1/16 inch; and (4) a laminate of a ¼ inch inner diameter (ID) 3 inch length surgical tubing closed at one end, with a wall thickness of 1/16 inch and a ⅛ inch inner diameter (ID) 3 inch length surgical tubing closed at one end, with a wall thickness of 1/16 inch with the ⅛ inch ID tube inside the ¼ inch ID tube.

Each of (1) and (2) was inflated to a diameter of 2.0 inches, with an elongation of 800%. Each of (3) and (4) was inflated to a diameter of 1.0 inches, with elongation of 800%. The expulsion pressure of (1), (2), (3) and (4) was measured. The results are tabulated in Table 2.

TABLE 2

| Air Expulsion Pressure | | | |
|---|---|---|---|
| (1) ¼" ID ⅛" wall Tube | (2) ¼" ID 1/16" wall Tube | (3) ⅛" ID 1/16" wall Tube | (4) ⅛" ID + ¼" ID tube Combination |
| 25 psi | 15 psi | 40 psi | 55 psi |

CONCLUSION

The combination of a ¼ in. ID tube inside a ⅛ in. ID tube generated an air expulsion pressure which was the sum of a ¼ in. ID tube and ⅛ in. ID tube in combination. The expulsion pressure of the combination of a ¼ in. ID tube and a ⅛ in. ID tube, with a total wall thickness of ⅛ in. wall thickness was 2.2 times higher than the expulsion pressure of a ¼ in. ID tube with a wall thickness of ⅛ in.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An aerosol spray generating power system comprising:

(a) a nozzle adapted to generate an aerosol vapour spray from a pressurized liquid;

(b) a first hollow elastic resilient open-ended closed bottom elongated cylindrical power tube, the open end communicating with the nozzle, the elastic resilient power tube having a circular flange around the open-end being adapted to contain liquid used to create the aerosol spray, the resilient power tube storing elastic energy on being expanded with a liquid and generating a pressure on the liquid when the resilient power tube is expanded with the liquid, the first power tube exerting an expelling force on the liquid when the nozzle is opened; and (c) a second hollow elastic resilient open-ended closed bottom elongated cylindrical power tube of an internal diameter greater than the external diameter of the first power tube, located on the exterior of the first resilient power tube, and being of a length longer than the first power tube to form a space between the closed bottom of the first power tube and the closed bottom of the second power tube, the second power tube having a circular flange around the open-end adapted to mate with the circular flange of the first power tube, the resilient second power tube storing elastic energy on being expanded with the liquid in the first power tube and generating a pressure on the liquid when the resilient second power tube is expanded with the liquid, the first resilient power tube and the second resilient power tube being independent of one another in movement but cooperating together when expanded with the liquid in the first hollow power tube to provide a cumulative pressure on the liquid to thereby together dispense the liquid through the nozzle when the nozzle is open; and (d) a collar connected to the base of the nozzle and being adapted to hold the mating flanges of the first and second power tubes and thereby causing the open end of the first power tube and the open end of the second power tube to communicate with the nozzle.

2. An apparatus as defined in claim 1 wherein the first resilient power tube acts as a liner which separates the liquid from the second resilient power tube.

3. An apparatus as defined in claim 2 wherein the first resilient power tube is formed of a material selected from the group of materials consisting of food grade silicone rubber, natural latex, and Neoprene.

4. An apparatus as defined in claim 1 wherein the second resilient power tube is formed of natural rubber.

5. An apparatus as defined in claim 4 wherein the second resilient power tube is capable of expanding at least about 600%.

6. An apparatus as defined in claim 5 wherein the first resilient power tube is capable of expanding at least about 800%.

7. An apparatus as defined in claim 6 wherein the first resilient power tube and the second resilient power tube are housed in a container, and the nozzle is located at the top of the container and is attached to the container and attached by the collar to the open ends of the pair of power tubes.

* * * * *